US006252482B1

(12) United States Patent
Chiba et al.

(10) Patent No.: US 6,252,482 B1
(45) Date of Patent: Jun. 26, 2001

(54) IGNITION COIL WITH LOCATING PROJECTION IN APERTURE FOR TOWER-SIDE TERMINAL

(75) Inventors: Tomonari Chiba, Nishikamo-gun; Kazutoyo Oosuka, Gamagori; Keiichi Okazaki, Ichinomiya; Hiromitsu Oonishi, Nagoya; Masahiko Aoyama, Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/208,770

(22) Filed: Dec. 10, 1998

(30) Foreign Application Priority Data

Dec. 25, 1997 (JP) ..... 9-356425
Dec. 25, 1997 (JP) ..... 9-357144

(51) Int. Cl.[7] ..... H01F 27/02; H01F 27/28

(52) U.S. Cl. ..... 336/96; 336/96; 336/90; 336/92; 123/634; 123/635

(58) Field of Search ..... 336/107, 90, 92, 336/96, 634, 635; 123/634, 635

(56) References Cited

FOREIGN PATENT DOCUMENTS

| | | |
|---|---|---|
| 59-155720 U | 10/1984 | (JP) . |
| 5-21240 | 1/1993 | (JP) . |
| 8-213259 | 8/1996 | (JP) . |
| 9-275026 | 10/1997 | (JP) . |

OTHER PUBLICATIONS

U.S. Patent Application SN 08/567708, filed Dec. 05, 1999.

*Primary Examiner*—Michael L. Gellner
*Assistant Examiner*—Minh Nguyen
(74) *Attorney, Agent, or Firm*—Nixon & Vanderhye P.C.

(57) ABSTRACT

A high voltage post terminal is accurately located within a support aperture during manufacturing processes by at least one inwardly directed projection to avoid assembly problems caused by sizing the entire aperture itself to locate the terminal with sufficient accuracy. By thus improving the concentricity of the high voltage coil components it is possible to achieve more reliable insulation between components at even relatively small-sized coils used for individual engine plug holes. An especially advantageous range of critical parameters has been discovered as achievable by using this more reliable manufacturing process.

31 Claims, 7 Drawing Sheets

IGNITION COIL WITH LOCATING PROJECTION IN APERTURE FOR TOWER-SIDE TERMINAL

CROSS REFERENCE TO RELATED APPLICATION

This application is based on and incorporates herein by reference Japanese Patent Application Nos. Hei 9-213073 filed on Aug. 7, 1997, Hei 9-356425 filed on Dec. 25, 1997, and Hei 9-357144 filed on Dec. 25, 1997.

BACKGROUND OF THE INVENTION

1. Field of the Invention

The present invention relates to an ignition coil for installation inside an engine plug-hole.

2. Related Art

A conventional stick-type ignition coil includes primary and secondary coils rolled around two spools having respective different diameters and a bar-like center core. The primary and secondary coils and the center core are concentrically installed inside a cylindrical coil casing. A high-voltage terminal connectable to an ignition plug is attached to the lower end of the coil casing by adhesive. Filler such as epoxy-based thermosetting resin fills the upper otherwise open end of the coil casing. In this conventional ignition coil, as shown in FIGS. 9A and 9B, a high-voltage terminal 1 is formed at one coil and by bending copper wire into a U-shape, for reducing manufacturing cost. This high voltage terminal 1 is vertically press-inserted into a terminal support 2 integrally formed at the lower end of the secondary spool 5. Further, a pin-shaped central high-voltage terminal 3 protruding upwardly from a high-voltage tower portion (not illustrated) is upwardly inserted into and connected to the U-shaped high-voltage terminal 1. Here, the terminal support 2 has a circularly-shaped terminal insertion hole 4 into which the high-voltage terminal 3 is upwardly inserted.

However, as shown in FIG. 9B, when the high-voltage terminal 3 is pinched by the U-shaped high-voltage terminal 1, both sides of the high-voltage terminal 3 are expanded to a certain degree to attain sufficient contacting pressure therebetween. In this condition, the resilient forces of both sides of the high-voltage terminal 1 push the high-voltage terminal 3 toward the opening side of the U-shaped high-voltage terminal 1 as denoted by arrow A. When the high-voltage terminal 3 is inserted into the high-voltage terminal 1, the coil casing is not yet filled and the lower end of the secondary spool 5 (terminal support 2) is not fixed. Thus, the lower end of the secondary spool 5 slides toward the opposite side of arrow A to an eccentric position due to the reaction force acting on high-voltage terminal 3 opposite arrow A. Therefore, the desired concentricity between each component inside the coil casing is reduced and the electrical insulating distance therebetween varies, thereby reducing the degree of insulation between components.

In this case, as the maximum offset of the secondary coil 5 is defined by clearance B between the terminal insertion hole 4 and the high-voltage terminal 3, the offset of spool 5 can be reduced by making clearance B small. However, when clearance B is made small, it becomes more difficult to insert high-voltage terminal 3 into hole 4, and the assembling process becomes less desirable. That is, in the above-described conventional high-voltage terminal connection structure, it is difficult to simultaneously attain both high accuracy distances between assembled parts (insulating performance) and efficient, relatively easy assembly processes.

JP-A-8-213259 discloses another conventional stick type ignition coil. This ignition coil includes, as shown in FIG. 10, a bar-like center core 102, a secondary coil 104 rolled around a secondary spool 103 disposed at the outer side of center core 102, a primary coil 106 rolled around a primary spool 105 disposed at the outer side of secondary coil 104, and an outer core 107 disposed at the outer side of primary coil 106. A thermosetting resin fills the gaps between these components to attain electrical insulation and mechanical strength inside housing 101.

In general, an ignition coil needs to be installed in a restricted space like an engine plug-hole in which the coil portion outer diameter is less than 24 mm. Thus, permanent magnets 109, 110 need to be disposed at both ends of center core 102 for generating required ignition coil voltage. Here, the excitation poles of permanent magnets 109, 110 are opposite to the polarity of center core 102.

A rare-earth magnet such as neodymium is used for permanent magnets 109, 110, so as to generate sufficiently high magnetic force in the restricted small space. The need for permanent magnets 109, 110 increases manufacturing cost for the ignition coil.

SUMMARY OF THE INVENTION

The present invention provides an ignition coil with improved assembling accuracy and process for connecting together a coil-side high-voltage terminal and a tower-side high-voltage terminal.

The invention also provides required ignition coil performance without a permanent magnet.

In one exemplary embodiment, a convex portion is formed at the inner peripheral surface of a terminal insertion hole to improve assembling accuracy of a tower-side high-voltage terminal with respect to the terminal insertion hole. That is, the lower portion of a secondary spool (terminal support portion) is very accurately set in place with respect to the tower side high-voltage terminal. In this way, the convex portion can adjust the center of the secondary spool lower end, thereby improving concentricity and insulating performance between components inside a coil casing.

As the convex portion improves concentricity, the inner diameter of the terminal insertion hole does not need to be made so small. Even when the tower-side high-voltage terminal contacts the convex portion while the tower-side high-voltage terminal is inserted into the terminal insertion hole, because the contacting area is small, the resistant force is not so large. Therefore, the tower-side high-voltage terminal can be easily inserted into the terminal insertion hole. In general, the terminal support portion and the convex portion are made of insulating resin (as is the spool). Thus, when the tower-side high voltage terminal contacts the convex portion, the convex portion easily moves relative to the outer shape of the tower-side high-voltage terminal. As a result, the resisting force is made small, and assembling performance is improved.

If the diameter x mm of a center core and the thickness y mm of an outer core satisfy certain specified relationships, the size of an ignition coil having no permanent magnet need not be substantially increased with respect to a coil having permanent magnets.

BRIEF DESCRIPTION OF THE DRAWINGS

Additional objects and advantages of the present invention will be more readily apparent from the following detailed description of preferred exemplary embodiments when taken together with the accompanying drawings in which.

DETAILED DESCRIPTION OF PREFERRED EXEMPLARY EMBODIMENTS (First Embodiment)

Figure 1:
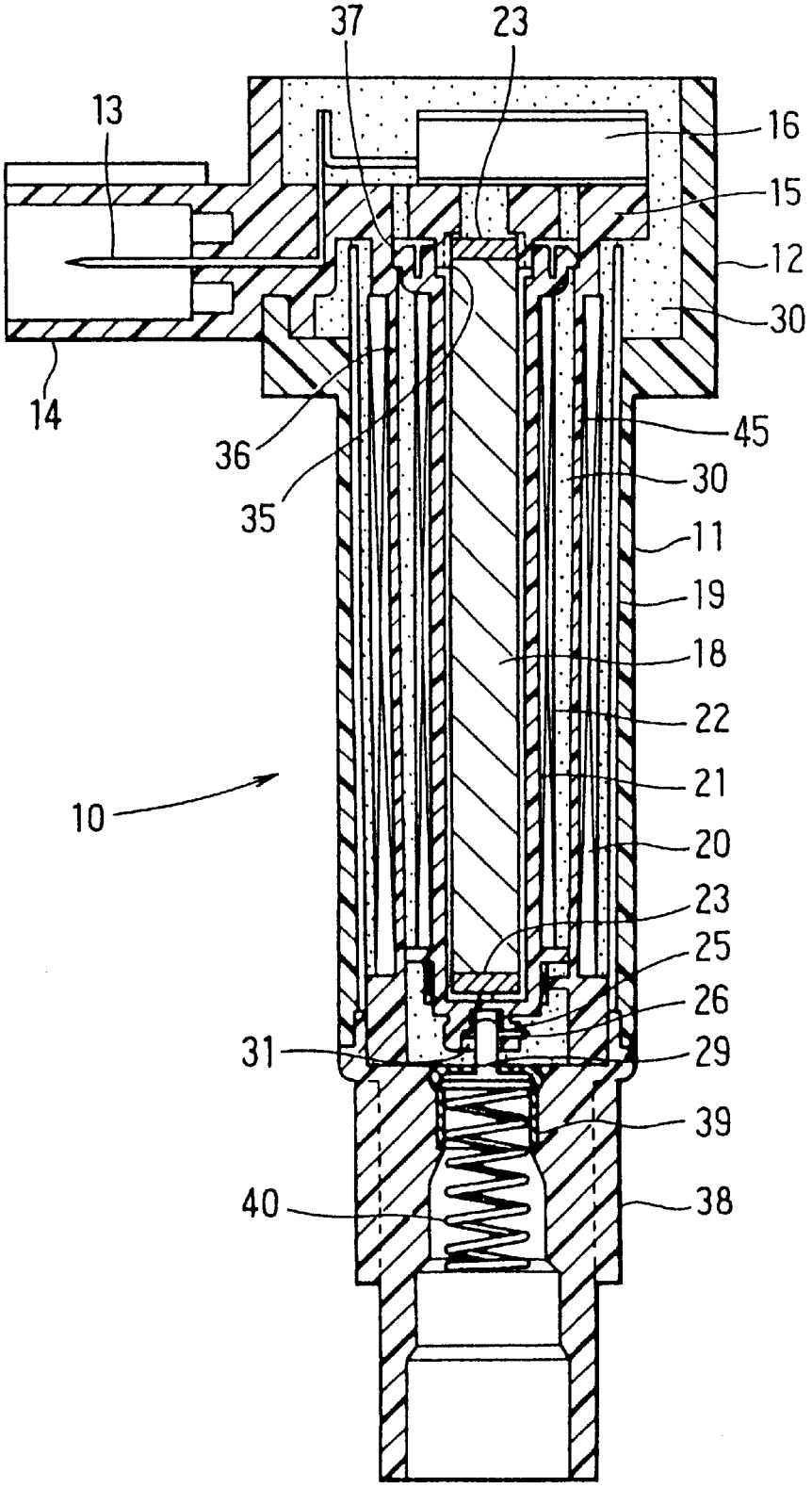
FIG. 1 is a cross-sectional view showing an ignition coil according to a first embodiment.

A first embodiment will be described with reference to FIGS. 1–5. FIG. 1 shows the entire structure of an ignition coil 10.

A cylindrical coil casing 11 is made of insulating resin, and has a head casing 12 integrally formed at its upper end. A connector housing 14, into which connector pin 13 is insert-formed, is press-inserted to head casing 12. The connector housing 14 includes an integral base plate 15. An igniter 16 is installed on base plate 15. An igniting signal from an engine-control computer (not illustrated) is input into igniter 16 through connector pin 13.

Inside coil casing 11, a bar-like center core 18 and a cylindrical outer core 19 are concentrically installed. A primary coil 20 rolled around a primary spool 45 made of insulating resin is installed inside cylindrical outer core 19. A secondary coil 22 rolled around a secondary spool 21 made of insulating resin is installed inside primary coil 20. The center core 18 is installed inside secondary spool 21. Cushion members 23 are provided at upper and lower ends of center core 18. The cushion members 23 are made of heat resistant elastic material such as anti-magnetic strain sponge, an elastomer or the like. Inside coil casing 11 and head casing 12, an insulating resin such as an epoxy-based thermosetting resin is vacuum filled as filler 30.

An inner set-place cylindrical portion 35 is provided for establishing the fitted position of the upper end of secondary spool 21. An outer set-place cylindrical portion 36 is provided for establishing the position of the upper end of the primary spool 45. The set-place portions 35 and 36 are integrally formed at the under surface of base plate 15 of connector housing 14. The upper end of secondary spool 21 is fitted into a ring-like gap between both set-place cylindrical portions 35, 36. Here, the secondary spool 21 has an elastic attaching nail 37 integrally formed at its upper end. The elastic attaching nail 37 protrudes toward the outer peripheral side of secondary spool 21, and is attached into the step portion of the outer set-place cylindrical portion 36. In this way, the secondary spool 21 is connected to the base plate 15. The upper end of center core 18 is fitted into the inside of the inner set-place cylindrical portion 35. Thereby the upper end of center core 18 is established.

Figure 2:
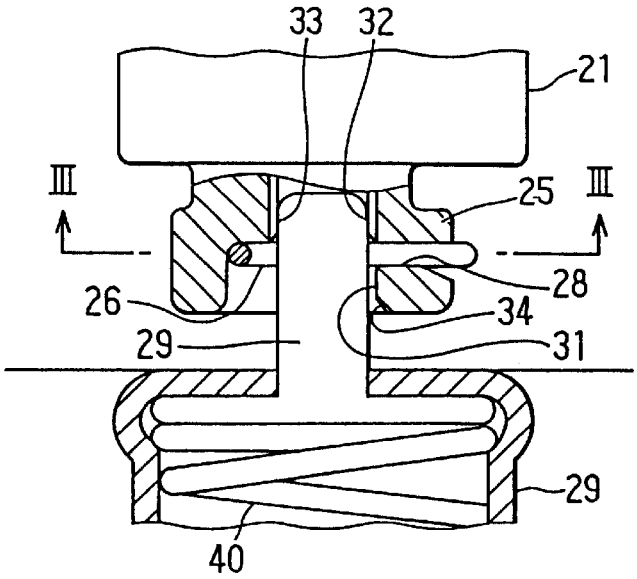
FIG. 2 is an enlarged principal view showing a connecting portion between a secondary coil-side high-voltage terminal and a tower-side high-voltage terminal.
Figure 3:
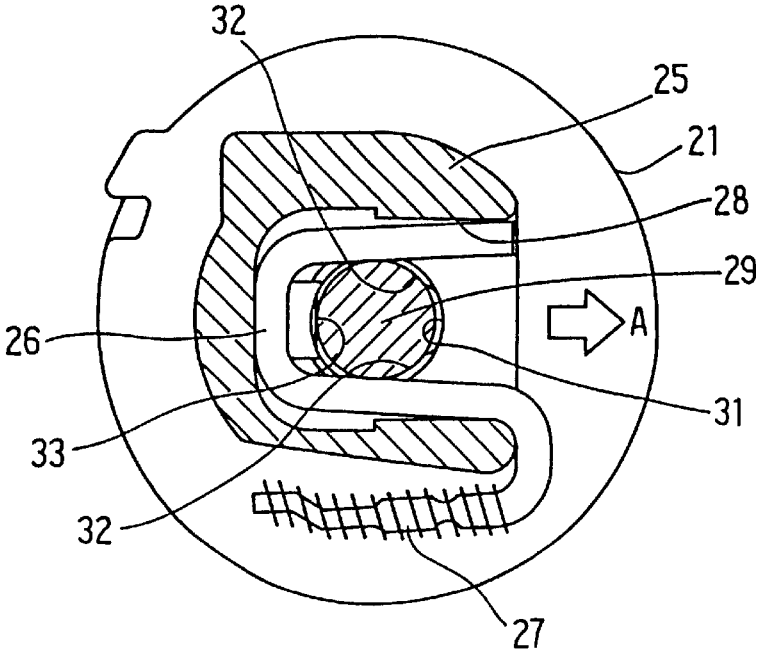
FIG. 3 is a cross-sectional view taken along line III—III in FIG. 2.
Figure 4:
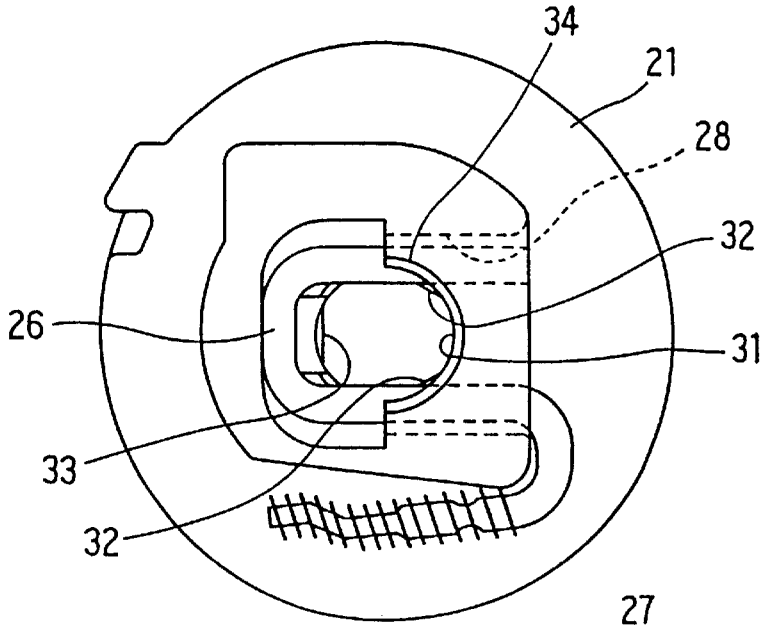
FIG. 4 is an enlarged view showing the connecting portion before the tower-side high-voltage terminal is inserted into the coil-side high-voltage terminal.
Figure 5:
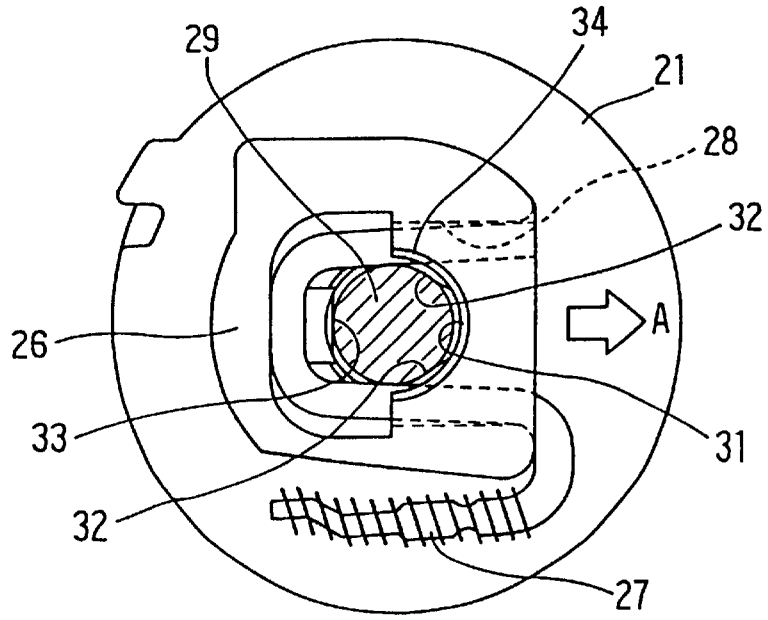
FIG. 5 is an enlarged view showing the connecting portion after the tower-side high-voltage terminal is inserted into the coil-side high-voltage terminal.

A terminal support portion 25 is integrally formed at the lower end of secondary spool 21. A coil-side high-voltage terminal 26 connected to one end of secondary coil 22 is connected to terminal support portion 25. The coil-side high-voltage terminal 26 is, as shown in FIGS. 3–5, made by bending one end of a lead wire (such as copper wire) into substantially U-shape. The coil-side high-voltage terminal 26 also defines a connecting portion 27 at its other end connected to one end of secondary coil 22. The coil-side high-voltage terminal 26 is, as shown in FIGS. 2, 3, press inserted horizontally into an insertion hole 28 of the terminal support portion 25 and fixed thereto.

At the center of terminal support portion 25, a circularly shaped terminal insertion hole 31 is formed into which a tower-side high-voltage terminal 29 described below is inserted upwardly. The terminal insertion hole 31 defines a tapered surface 34 at its lower end inner peripheral edge for guiding the insertion of the tower-side high-voltage terminal 29. Three locating convex portions 32, 33 are formed at the inside surface of terminal insertion hole 31 for establishing the location of tower-side high-voltage terminal 29. These locating convex portions 32, 33 are formed above the coil-side high-voltage terminal 26 to have substantially equal distances from each other. Out of these locating convex portions 32, 33, two convex portions 32 are formed at the opening side (right side in FIG. 3) of the coil-side high-voltage terminal 26, and one remaining convex portion 33 is formed at the bottom side (left side in FIG. 3) of the coil-side high-voltage terminal 26. The lower portion of each convex portion 32, 33 has an inclined surface inclining diagonally upwardly with respect to the inner periphery of terminal support portion 25. The inclining surface guides the tower-side high-voltage terminal 29 as it is being inserted. Here, the convex portions 32, 33 may be press contacted, merely contacted, or only made to be adjacent to the tower-side high-voltage terminal 29 inserted into terminal insertion hole 31.

As shown in FIG. 1, high-voltage tower portion 38 made of insulating resin is connected to the lower end of coil casing 11 by adhesive. In the upper central portion of this high-voltage tower portion 38, a terminal cup 39 is insert formed to which the pin-shaped tower side high-voltage terminal 29 is upwardly affixed. The coil-side high-voltage terminal 26 pinches tower side high-voltage terminal 29, and these are thus electrically connected with each other. When high-voltage tower portion 38 is inserted into an engine plug hole (not illustrated) and press-inserted onto the top of an ignition plug terminal (not illustrated), an electrically conductive spring 40 inside terminal cup 39 is press-contacted onto an ignition plug terminal. Thus, one end of secondary coil 22 is electrically connected to an ignition plug terminal through coil-side high-voltage terminal 26, tower-side high-voltage terminal 29, terminal cup 39 and spring 40.

The above described ignition coil 10 is assembled as explained hereinafter.

At first, each component such as secondary coil 22, primary coil 20, center core 18 and the like is installed inside coil casing 11. Then, high-voltage tower portion 38 is connected to the lower end of coil casing 11. At this time, tower-side high-voltage terminal 29 is inserted upwardly into terminal insertion hole 31 of terminal support member 25 and pinched into contact with the U-shaped coil-side high-voltage terminal 26.

Here, before tower-side high-voltage terminal 29 is pinched by the coil-side high-voltage terminal 26, as shown in FIG. 4, the distance between both sides of the U-shaped portion of coil-side high-voltage terminal 26 is smaller than the diameter of tower-side high-voltage terminal 29. However, after tower-side high-voltage terminal 29 is pinched by the coil-side high-voltage terminal 26, as shown in FIGS. 3 and 4, both sides of the U-shaped portion of the coil-side high-voltage terminal 26 are expanded. Under this condition, the resilient forces from both sides of coil-side high-voltage terminal 26 push the tower-side high-voltage terminal 29 toward the opening side of the coil-side high-voltage terminal 29 as denoted by arrow A.

Here, because the convex portions 32, 33 are formed at the inner periphery of terminal insertion hole 31, the lower end (terminal support portion 25) of secondary spool 21 is prevented by these convex portions 32, 33 from sliding toward the opposite direction of arrow A due to the resilient forces of the coil-side high-voltage terminal 26. Thus, the lower end (terminal support member 25) of secondary spool 21 can be accurately located with respect to the tower-side high-voltage terminal 29. That is, the convex portions 32, 33 adjust the center location of the lower end portion of secondary spool 21, thereby improving concentricity between components inside coil casing 11 and therefore improving the consistency of insulation performance therebetween.

In general, in the past, when the inner diameter of terminal insertion hole 31 is made small in an attempt to minimize clearance so as to improve concentricity, it becomes difficult to insert tower-side high-voltage terminal 29 into terminal insertion hole 31 and assembling efficiency is lessened. However, in the present embodiment, because the convex portions 32, 33 together with resilient forces in the direction of arrow A improve concentricity, the inner diameter of the terminal insertion hole no longer needs to be made so small. Further, during insertion, even when tower-side high-voltage terminal 29 contacts or press-contacts convex portions 32, 33, the resistant forces upon insertion are not so large because the contacting area of these portions is comparatively small. Thus, tower side high-voltage terminal 29 is comparatively more easily inserted into terminal insertion hole 31.

In the present embodiment, terminal support member 25 and convex portions 32, 33 are made of insulating resin as is secondary spool 21. Thus, when tower side high-voltage terminal 29 press-connects with convex portions 32, 33, convex portions 32, 33 transform in accordance with the outer shape of tower-side high-voltage terminal 29. Therefore, the contact resistant forces caused by convex portions 32, 33 during the insertion operation are small. Thus, assembling efficiency is improved.

Further, in the present embodiment, because three convex portions 32, 33 are formed at the inner peripheral surface of terminal insertion hole 31, the tower side high-voltage terminal is accurately located at the center of terminal insertion hole 31. Thereby, concentricity between them is improved. This effect can also be attained when four or more convex portions are present.

Here, the number of convex portions may be two or only one. In this case, one main object of the present invention still can be sufficiently achieved. Further, the shape of coil-side high-voltage terminal 26 is not restricted to a substantially U-shape, but may be a substantially V-shape instead.

In general, the outer diameter of center core 18 of ignition coil 10 having no permanent magnet, as in the present embodiment, is larger than that in an ignition coil having permanent magnets. Therefore, the insulating distance between the secondary coil and the primary coil must be small. The present invention is much more effective for this type of ignition coil, because the internal coil parts are suppressed from becoming eccentric and thus retain sufficient insulating distance therebetween via convex portions 32, 33.

Further, the coil shape is not restricted to the above-described shapes. For example, a spool without a high-voltage side flange may be used. Here, because the spool without a flange is likely to become more eccentric than the spool provided with a flange, the advantages of the present invention are even more pronounced.

(Second Embodiment)

A second embodiment provides an ignition coil that can be downsized even when permanent magnets are eliminated from the center core as in the first embodiment.

The second embodiment will be described with reference to FIGS. 6–8.

Figure 6:
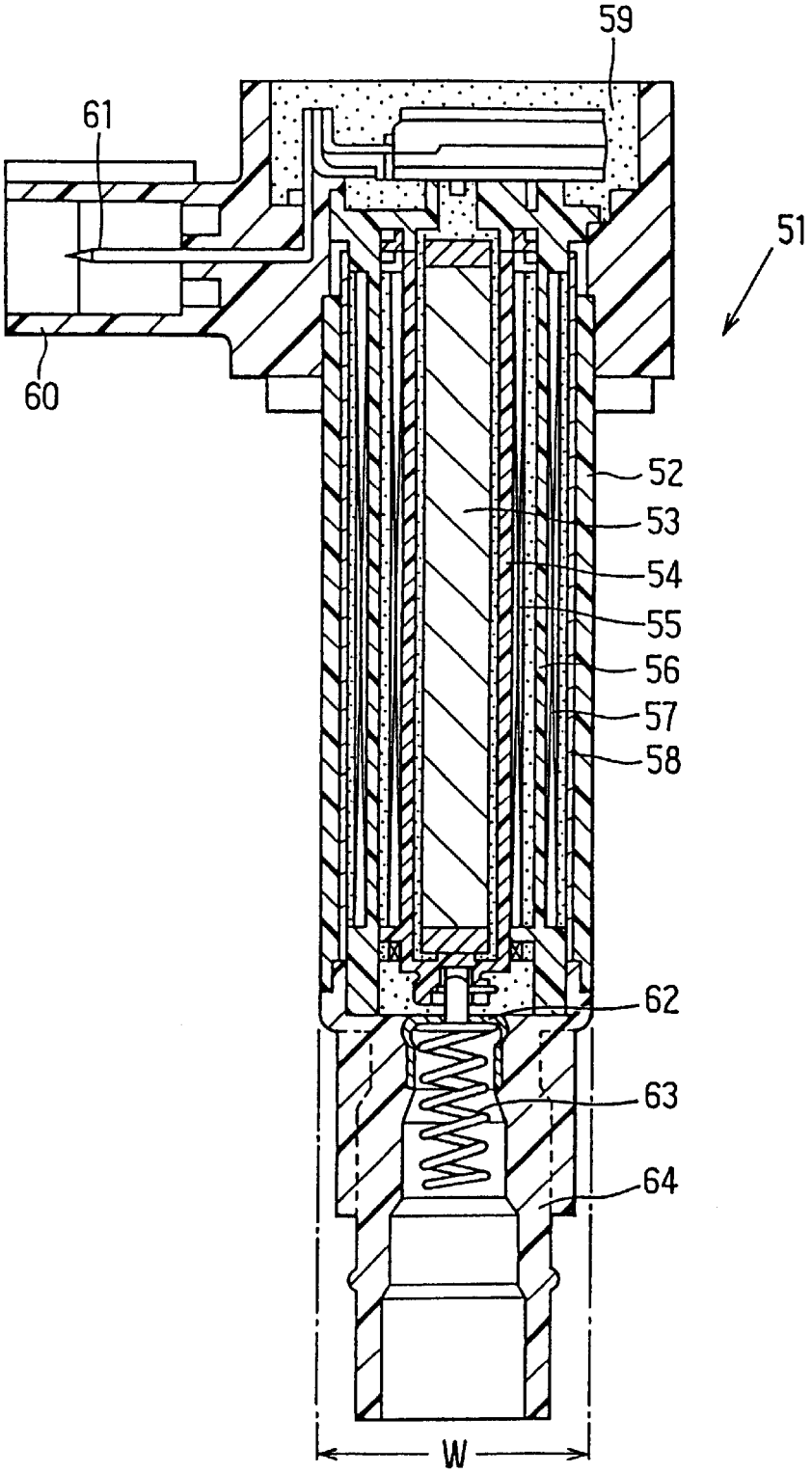
FIG. 6 is a cross-sectional view showing an ignition coil according to second embodiment.

As shown in FIG. 6, an ignition coil 51 is installed in a plug-hole formed in every cylinder of an engine, and electrically connected to an ignition plug (not illustrated). The outer diameter W of a coil portion, which is located in the plug-hole, is typically less than 24 mm.

The ignition coil 51 includes cylindrical housing 52 made of resin. In the housing 52, a center core 53, a secondary spool 54, a secondary coil 55, a primary spool 56, a primary coil 57 and an outer core 58 are provided (in order from the center to the outside). A thermosetting insulating resin (for example, an epoxy-based resin) is filled in gaps between these internal elements.

The center core 53 is formed into columnar shape and constructed by laminating thin silicon steel plates in an axial direction. The center core 53 is located in place by the inside wall of secondary spool 54, and there is no permanent magnet at either end.

Secondary spool 54 forms the second coil 55. Secondary spool 54 is located in place by the inside wall of primary spool 56, and is made of resin.

Secondary coil 55 is formed cylindrically by rolling an insulated thin coil wire around the outer periphery of secondary spool 54. Secondary coil 55 is electrically connected to high-voltage terminal 62 as described below.

Primary spool 56 forms primary coil 57. Primary spool 56 is located in place by housing 52 and the inside wall of outer core 58, and is made of resin.

Primary coil 57 is formed cylindrically by rolling an insulated coil wire (thicker than the coil wire of secondary coil 55) around the outer periphery of primary spool 56. Primary coil 57 is electrically connected to input terminal 61 as described below.

Outer core 58 contacts the inside wall of housing 52. The outer core is shaped cylindrically with a slit to insulate a roll-start point from a roll-end point of the thin silicon steel plate.

A thermosetting insulating resin 59 fills gaps between each component assembled in housing 52, and firmly insulates these components from each other. Further, the thermosetting insulating resin 59 fixes and integrates these components to prevent them from being broken apart by vibration.

Connector 60 is provided at the upper end of housing 52 in such a manner that it protrudes from the plug-hole. The input terminal 61 is insert-formed in connector 60, which supplies a control signal to primary coil 57. Here, a switching circuit (not illustrated) supplying a control signal to input terminal 61 is disposed outside ignition coil 51.

The high-voltage terminal 62 is insert-formed or press-formed at the lower end of housing 52, and electrically connected to spring 63. The spring 63 is electrically connected to ignition coil 51 when it is installed in the plug-hole. A high-voltage generated in secondary coil 55 is supplied to the ignition plug through high-voltage terminal 62 and spring 63.

A high-voltage tower portion 64 made of insulating resin is connected to the lower end opening of housing 52.

The above-described ignition coil 51 satisfies the following conditions.

Figure 7:
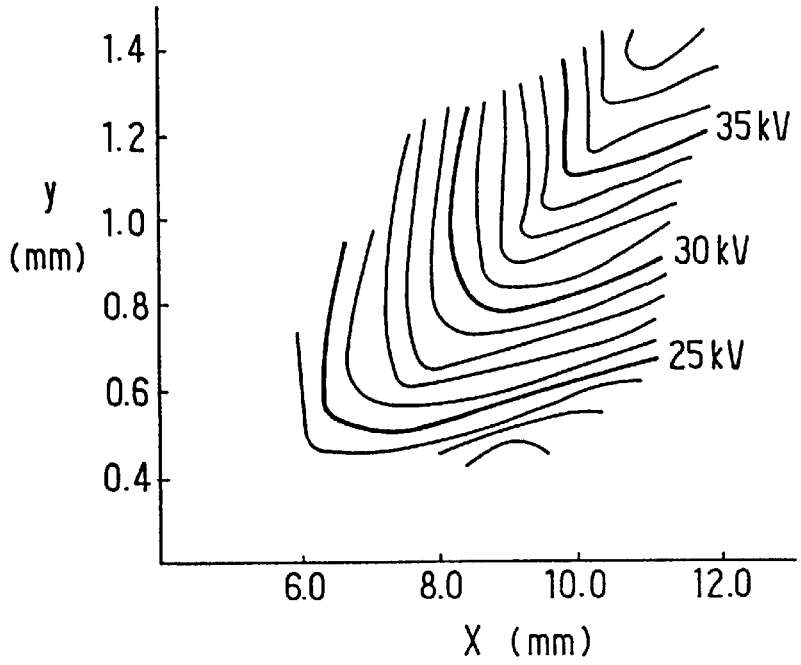
FIG. 7 is a graph showing a magnetic simulation result when a steel tube is applied.
Figure 8:
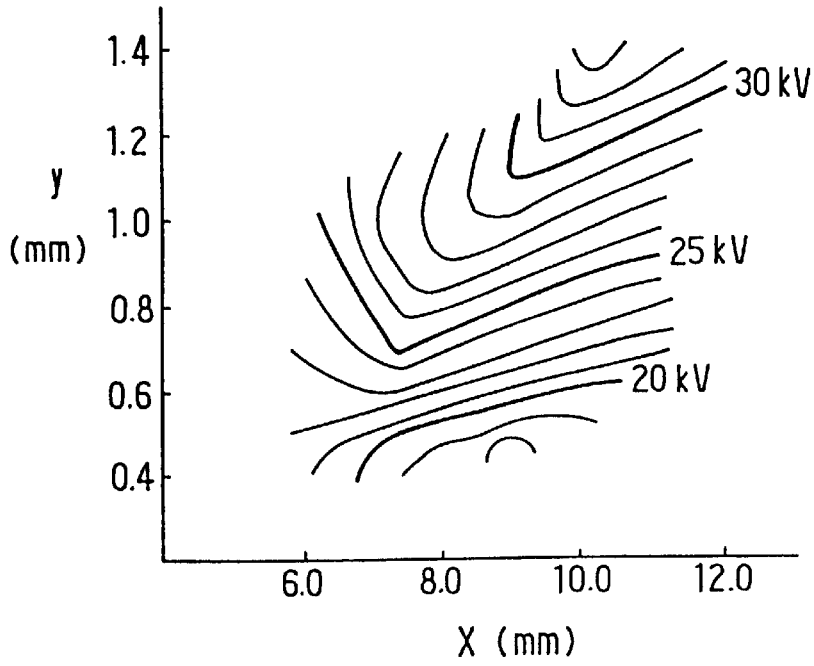
FIG. 8 is a graph showing a magnetic simulation result when an aluminum tube is applied.
Figure 9A:
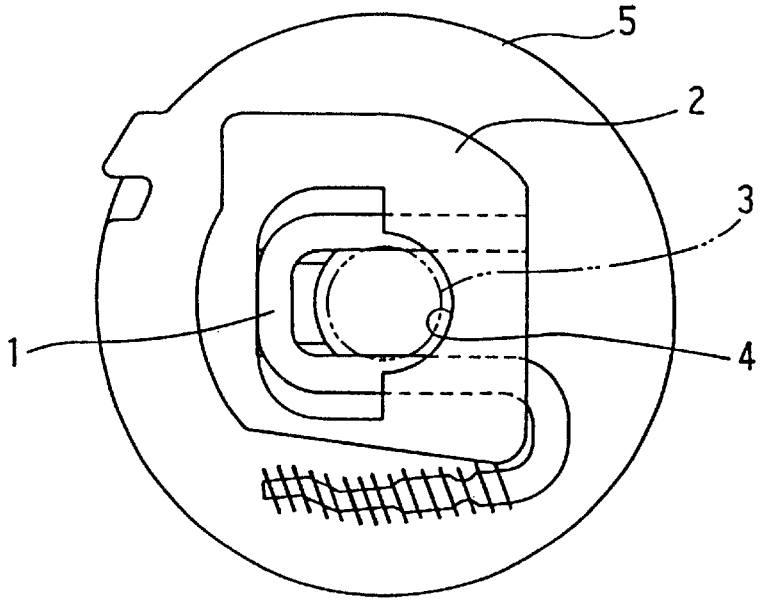
FIG. 9A PRIOR ART
FIG. 9A is an enlarged view showing the connecting portion of a conventional ignition coil before the tower-side high-voltage terminal is inserted into the coil-side high-voltage terminal.
Figure 9B:
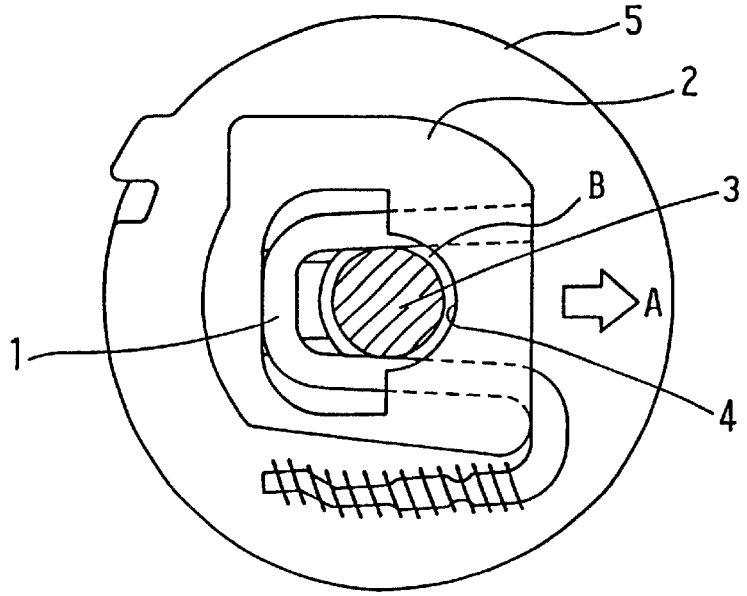
FIG. 9B PRIOR ART
FIG. 9B is an enlarged view showing the connecting portion of the conventional ignition coil after the tower-side high-voltage terminal is inserted into the coil-side high-voltage terminal.
Figure 10:
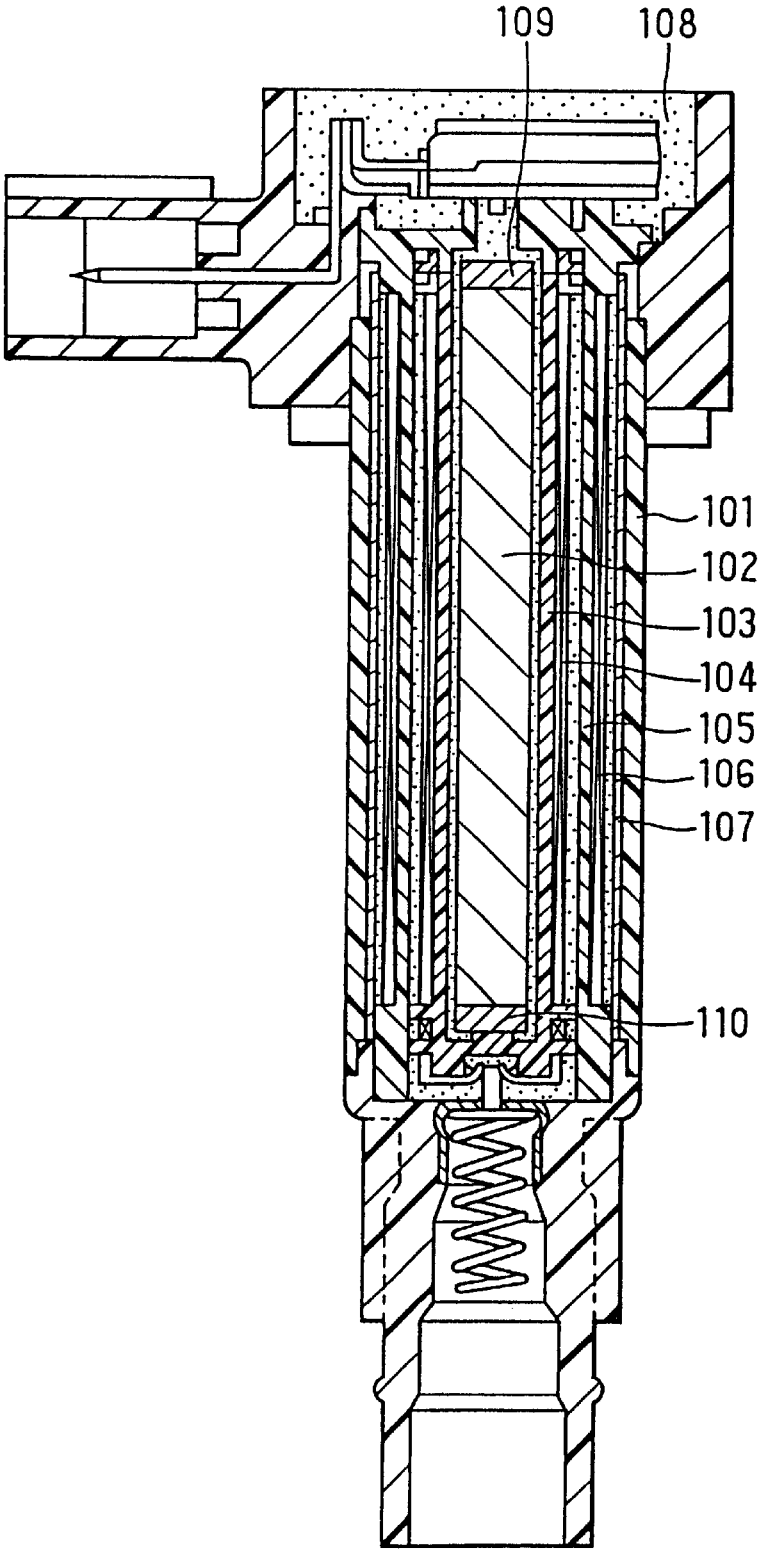
FIG. 10 PRIOR ART
FIG. 10 is a cross-sectional view showing a prior art ignition coil.

FIGS. 7 and 8 are magnetic simulation graphs showing simulation results of generated voltage in accordance with relations between the diameter x mm of center core 53 and the thickness y mm of outer core 58. Here, FIGS. 7 and 8 show simulation results under a condition that primary coil 57 has 230 turns and secondary coil 55 has 17,480 turns and the electric current supplied to primary coil 57 is 6.5 A. FIG. 7 shows the result in the case where an iron tube is rolled around the plug tube, and FIG. 8 shows the result in the case where an aluminum tube is rolled around the plug tube.

As is understood from FIGS. 7 and 8, when one of center core 53 and outer core 58 magnetically saturates at a predetermined voltage, there arises a substantial L-shape characteristic. Near this characteristic bent point, a relation ratio can be discerned in which waste of center core diameter and outer core thickness is minimized. This characteristic bent point area generally exists in the vicinity of where $(11/50)x-1.3 \leqq y \leqq (11/50)x-0.6$, in a generated voltage range of 25 kV–40 kV.

The inventors have carried out various experiments, and have concluded that generated voltages of 25 kV–40 kV can be attained when the center core diameter x mm and the outer core thickness y mm are chosen to satisfy the following relationships:

$$(11/50)x-1.3 \leqq y \leqq (11/50)x-0.6$$

$$6.0 \leqq x \leqq 11.0$$

$$0.5 \leqq y \leqq 1.5$$

The inventors have concluded that generated voltages of more than 30 kV can be attained when the center core diameter x mm and the outer core thickness y mm are set to satisfy the following relationships:

$$6.0 \leqq x \leqq 11.0$$

$$0.5 \leqq y \leqq 1.5$$

Further, the inventors have concluded that the above described characteristic is attained when the ampere-turns A×T are within 700–2500, and preferably within 800–2000. Here, the ampere-turns A×T are defined as a product of the amperage A of the electric current supplied to primary coil 57 and the number of turns T of primary coil 57. In the present exemplary embodiment, as an optimum example, the electric current amperage is set to 6.5 A and the turn number of primary coil 57 is set to 230T. Therefore, the product ampere-turn A×T is about 1500.

Here, cross-sectional area influences magnetic saturation of outer core 58. That is, magnetic saturation of outer core 58 is influenced by not only by its thickness but also by its diameter. Then, the inventors concluded that the above-described characteristic is attained when the outer diameter of the outer core 58 is set within 20–24 mm.

In the present embodiment, there exists housing 52 of which its thickness is 0.5–1.0 mm at the outside of outer core 58, and the outer diameter W of the coil portion is set to about 22.0–23.5 mm, for example. According to these restrictions, the outer diameter of the outer core 58 of the present exemplary embodiment is set within 20.0–23.0 mm.

By setting each element to satisfy the above-described relationships, the outer diameter W of the coil portion is kept under 24.0 mm even when a permanent magnet is not used in center core 53, and one is able to generate the required voltage. That is, ignition coil 51 does not have to be upsized.

Further, as ignition coil 51 generates the r equired voltage without a permanent magnet, its manufacturing cost is reduced.

In the above-described embodiments, housing 52 is provided at the outside of outer core 58. Alternatively, outer core 58 may finction as the housing, without using housing 52. In this case, seizing rubber to the slit of outer core 58 seals the inside of outer core 58.

When housing 52 is not provided at the outside of outer core 58, the outer diameter of outer core 58 is set within 22.0–23.5 mm.

The present invention is not restricted to be applied to a stick type ignition coil, and may be applied to an ignition coil having a connecting portion between a secondary coil-side terminal and a high-voltage tower-side terminal.

While some exemplary embodiments of the invention have been described in detail, those skilled in the art will appreciate that many variations and modifications may be made in these exemplary embodiments while yet retaining some or all of the benefits and advantages of this invention. Thus all such variations and modifications are to be included within the scope of the following claims.

What is claimed is:

1. An ignition coil comprising:

a coil casing;

a spool located inside said coil casing;

a coil wire rolled around said spool;

a terminal support portion located at a lower end of said spool;

a coil-side high-voltage terminal connected to said terminal support portion and including an approximately U or V-shaped conductor connected to an end of said coil wire;

a high-voltage tower portion connected to a lower end of said coil casing, said high-voltage terminal portion adapted for connection to an ignition plug;

a tower-side high-voltage terminal protruding upwardly from said high-voltage tower portion;

a terminal insertion hole formed in said terminal support member, into which said tower side high-voltage terminal is inserted during manufacture assembly; and at least one set-place convex portion formed at an inner peripheral surface of said insertion hole for locating the tower side high-voltage terminal, wherein said tower side high-voltage terminal is pinched by said coil-side high-voltage terminal and located by said at least one set-place convex portion.

2. An ignition coil according to claim 1, wherein said at least one set-place convex portion is located at an opening side of said coil-side high-voltage terminal.

3. An ignition coil according to claim 1, wherein at least three set-place convex portions are formed at the inner peripheral surface of said insertion hole.

4. An ignition coil according to claim 1, wherein a lower end of said at least one set-place convex portion is inclined diagonally upwardly toward the inside of said insertion hole.

5. An ignition coil according to claim 1, further comprising:

a columnar-shaped center core arranged at an inner side of said spool;

a primary coil disposed at an outer side of said coil wire; and a cylindrical outer core provided at an outer side of said primary coil, wherein an outer diameter of said primary coil is less than 24 mm, and a diameter x mm of said center core and a thickness y mm of said outer core satisfy following relationships:

$$(11/50)x-1.3 \leqq y \leqq (11/50)x-0.6$$

$$6.0 \leqq x \leqq 11.0$$

$$0.5 \leqq y \leqq 1.5.$$

6. An ignition coil according to claim 5, wherein said diameter x mm and said thickness y mm satisfy following relationships:

$$8.0 \leqq x \leqq 11.0$$

$$0.8 \leqq y \leqq 1.5.$$

7. An ignition coil according to claim 5, wherein the number of ampere-turns A×T, defined by the product of amperes A of electric current supplied to said primary coil and the number of turns T of said primary coil, is within a range of 700 through 2500.

8. An ignition coil according to claim 5, wherein the number of ampere-turns A×T, defined by the product of amperes A of electric current supplied to said primary coil and the number of turns T of said primary coil, is within a range of 800 through 2000.

9. An ignition coil according to claim 5, wherein the outer diameter of said outer core is within a range of 22.0 mm through 23.5 mm when a housing is not provided outside of said outer core.

10. An ignition coil according to claim 5, wherein the outer diameter of said outer core is within a range of 20.0 mm through 23.0 mm when a housing is provided outside of said outer core.

11. An ignition coil according to claim 1, further comprising:

a columnar-shaped center core arranged at an inner side of said spool;

a primary coil disposed at an outer side of said coil wire; and a cylindrical outer core provided at an outer side of said primary coil, wherein an outer diameter of said primary coil is less than 24 mm, and a diameter x mm of said center core and a thickness y mm of said outer core satisfy following relationships:

$$y=(11/50)x-a$$

$$6.0 \leqq x \leqq 11.0$$

$$0.5 \leqq y \leqq 1.5, \text{ and}$$

"a" is a numerical constant.

12. An ignition coil according to claim 11, wherein said diameter x mm and said thickness y mm satisfy following relationships:

$$8.0 \leqq x \leqq 11.0$$

$$0.8 \leqq y \leqq 1.5.$$

13. An ignition coil according to claim 11, wherein the number of ampere-turns A×T, defined by the product of amperes A of electric current supplied to said primary coil and the number of turns T of said primary coil, is within a range of 700 through 2500.

14. An ignition coil according to claim 11, wherein the number of ampere-turns A×T, defined by the product of amperes A of electric current supplied to said primary coil and the number of turns T of said primary coil, is within a range of 800 through 2000.

15. An ignition coil according to claim 11, wherein the outer diameter of said outer core is within a range of 22.0 mm through 23.5 mm when a housing is not provided outside of said outer core.

16. An ignition coil according to claim 11, wherein the outer diameter of said outer core is within a range of 20.0 mm through 23.0 mm when a housing is provided outside of said outer core.

17. A stick-type ignition coil for installation in an engine plug-hole, said coil comprising:

a columnar-shape center core;

a primary coil and a secondary coil disposed at an outer side of said center core; and a cylindrical outer core provided at an outer side of said primary and secondary coils, wherein said center core is not provided with a permanent magnet, an outer diameter of said primary coil is less than 24 mm, and a diameter x mm of said center core and a thickness y mm of said outer core satisfy following relationships:

$$(11/50)x-1.3 \leqq y \leqq (11/50)x-0.6$$

$$6.0 \leqq x \leqq 11.0$$

$$0.5 \leqq y \leqq 1.5.$$

18. An ignition coil according to claim 17, wherein said diameter x mm and said thickness y mm satisfy following relationships:

$$8.0 \leqq x \leqq 11.0$$

$$0.8 \leqq y \leqq 1.5.$$

19. An ignition coil according to claim 17, wherein the number of ampere-turns A×T, defined by the product of amperes A of electric current supplied to said primary coil and the number of turns T of said primary coil, is within a range of 700 through 2500.

20. An ignition coil according to claim 17, wherein the number of ampere-turns A×T, defined by the product of amperes A of electric current supplied to said primary coil and the number of turns T of said primary coil, is within a range of 800 through 2000.

21. An ignition coil according to claim 11, wherein the outer diameter of said outer core is within a range of 22.0 mm through 23.5 mm when a housing is not provided outside of said outer core.

22. An ignition coil according to claim 17, wherein the outer diameter of said outer core is within a range of 20.0 mm through 23.0 mm when a housing is provided outside of said outer core.

23. In an automotive ignition coil having a columnar center core and a transverse U-shaped coil connector at one end adapted to resiliently receive a high-voltage post terminal thereinto via an aperture in a terminal support structure during manufacture, the improvement comprising:

at least one discrete inclined locating projection protruding inwardly within said aperture and positioned to be in contact with said post terminal when it is resiliently engaged by said connector thus accurately locating the terminal relative to the terminal support structure to maintain accurate concentricity of ignition coil components while also facilitating efficient manufacturing assembly processes by not requiring the entire aperture to sufficiently small to accurately locate the terminal.

24. An improved automotive ignition coil as in claim 17 wherein:

said center core has a diameter of x mm, said coil includes a cylindrical outer core having a thickness of y mm and an inner diameter less than 24 mm, and the following relationships are satisfied:

$$(11/50)x-1.3 \leqq y \leqq (11/50)x-0.6$$

$$6.0 \leqq x \leqq 11.0$$

$$0.5 \leqq y \leqq 1.5.$$

25. An improved automotive ignition coil as in claim 23, wherein:

said center core has a diameter of x mm, said coil includes a cylindrical outer core having a thickness of y mm and an inner diameter less than 24 mm, and the following relationships are satisfied:

$$y=(11/50)x-a$$

$$6.0 \leqq x \leqq 11.0$$

$$0.5 \leqq y \leqq 1.5, \text{ and}$$

"a" is a numerical constant.

26. A stick-type ignition coil for installation in an engine plug-hole, said coil comprising:

a columnar-shaped center core;

a primary coil and a secondary coil disposed at an outer side of said center core; and a cylindrical outer core provided at an outer side of said primary and secondary coils, wherein said center core is not provided with a permanent magnet, an outer diameter of said primary coil is less than 24 mm, and a diameter x mm of said center core and a thickness y mm of said outer core satisfy following relationships:

$$y=(11/50)x-a$$

$$6.0 \leqq x \leqq 11.0$$

$$0.5 \leqq y \leqq 1.5,$$

and

"a" is a numerical constant.

27. An ignition coil according to claim 26, wherein said diameter x mm and said thickness y mm satisfy following relationships:

$$8.0 \leqq x \leqq 11.0$$

$$0.8 \leqq y \leqq 1.5.$$

28. An ignition coil according to claim 26, wherein the number of ampere-turns A×T, defined by the product of amperes A of electric current supplied to said primary coil and the number of turns T of said primary coil, is within a range of 700 through 2500.

29. An ignition coil according to claim 26, wherein the number of ampere-turns A×T, defined by the product of amperes A of electric current supplied to said primary coil and the number of turns T of said primary coil, is within a range of 800 through 2000.

30. An ignition coil according to claim 26, wherein the outer diameter of said outer core is within a range of 22.0 mm through 23.5 mm when a housing is not provided outside of said outer core.

31. An ignition coil according to claim 26, wherein the outer diameter of said outer core is within a range of 20.0 mm through 23.0 mm when a housing is provided outside of said outer core.

* * * * *